United States Patent [19]

Krautkremer et al.

[11] 4,220,111

[45] Sep. 2, 1980

[54] DRIVE AND CONTROL DEVICE FOR WATERCRAFT OR THE LIKE HAVING AT LEAST ONE PAIR OF STEERABLE PROPELLERS

[75] Inventors: Franz Krautkremer; Siegfreid Lais, both of Spay, Fed. Rep. of Germany

[73] Assignee: Schottel-Werft Josef Becker GmbH & Co. KG, Overspay, Fed. Rep. of Germany

[21] Appl. No.: 895,624

[22] Filed: Apr. 12, 1978

[30] Foreign Application Priority Data

Apr. 28, 1977 [DE] Fed. Rep. of Germany ..... 2718831

[51] Int. Cl.[3] ..... B63H 25/00

[52] U.S. Cl. ..... 440/53; 114/144 R; 114/144 A; 114/144 E; 74/480 B

[58] Field of Search ..... 114/151, 144 R, 144 RE, 114/144 A; 74/DIG. 8, 480 B; 115/18 R, 18 E, 12 R, 12 A, 34 R, 35, 37, 38

[56] References Cited

U.S. PATENT DOCUMENTS

| | | | |
|---|---|---|---|
| 2,486,049 | 10/1949 | Miller | 115/37 |
| 2,987,027 | 6/1961 | Wanzer | 114/144 E |
| 3,294,054 | 12/1966 | Norton | 115/37 |
| 3,521,589 | 7/1970 | Kemp | 115/35 |
| 3,603,278 | 9/1971 | Gehlen | 115/35 |
| 3,651,779 | 3/1972 | Norton | 115/35 |
| 4,088,087 | 5/1978 | Nitta | 115/18 R |

*Primary Examiner*—Trygve M. Blix
*Assistant Examiner*—D. W. Keen
*Attorney, Agent, or Firm*—Blanchard, Flynn, Thiel, Boutell & Tanis

[57] ABSTRACT

A watercraft having at least a pair of steerable propellers thereon spaced longitudinally along the center of the watercraft from a center of lateral resistance on the watercraft. The steerable propellers are also spaced equidistant from the longitudinal center line and on opposite sides thereof. The propellers are rotatably supported in underwater housings supported for angular movement through 360°. A control device is provided for varying the direction of applied thrust to the watercraft by systematically varying the axes of rotation of the propellers relative to each other, assuming the thrust force for each steerable propeller is of the same magnitude. The magnitude of thrust can be, if desired, varied to provide additional control variations for the watercraft.

14 Claims, 13 Drawing Figures

Fig. 8
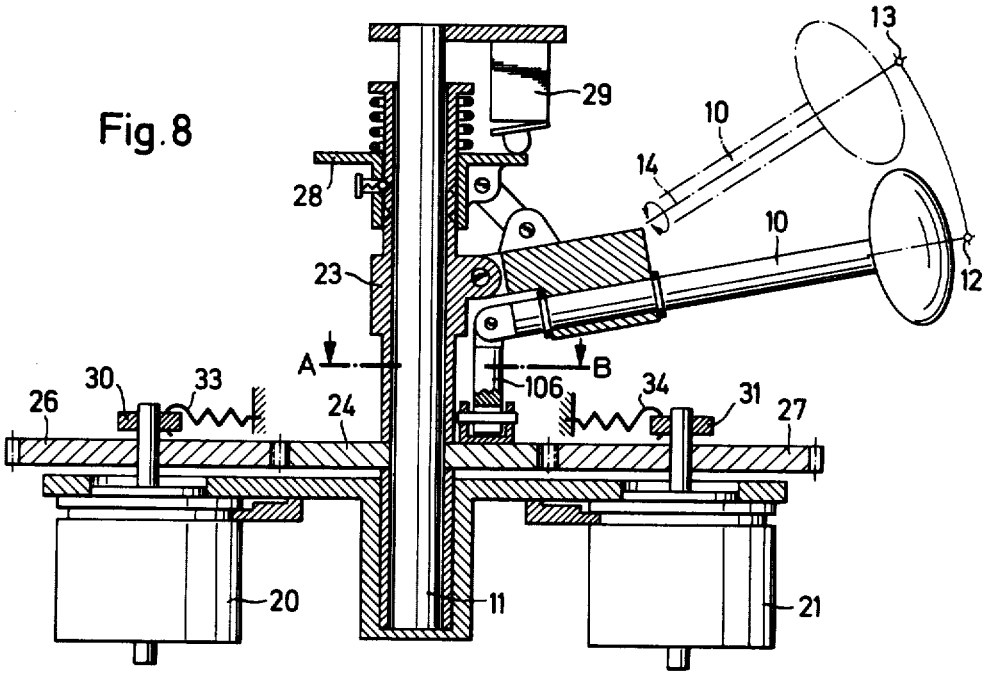
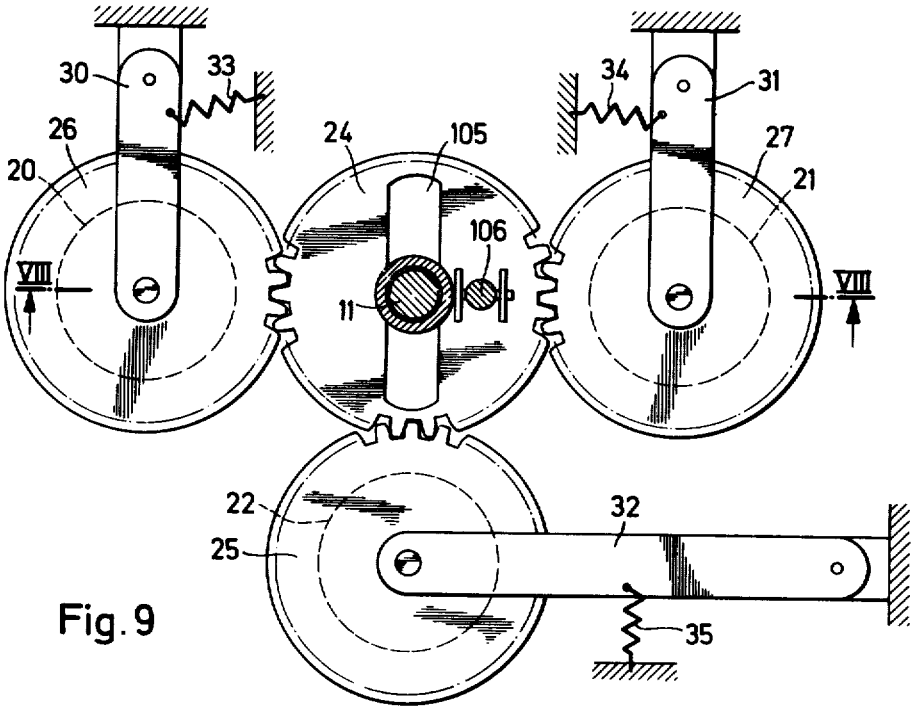
Fig. 9

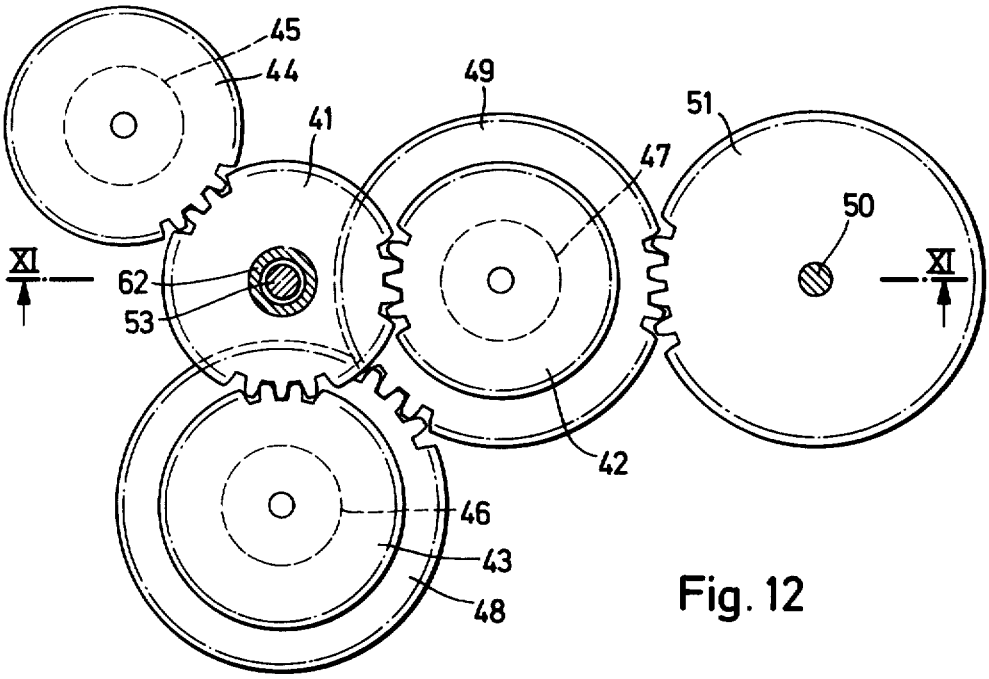
Fig. 12
Fig. 13
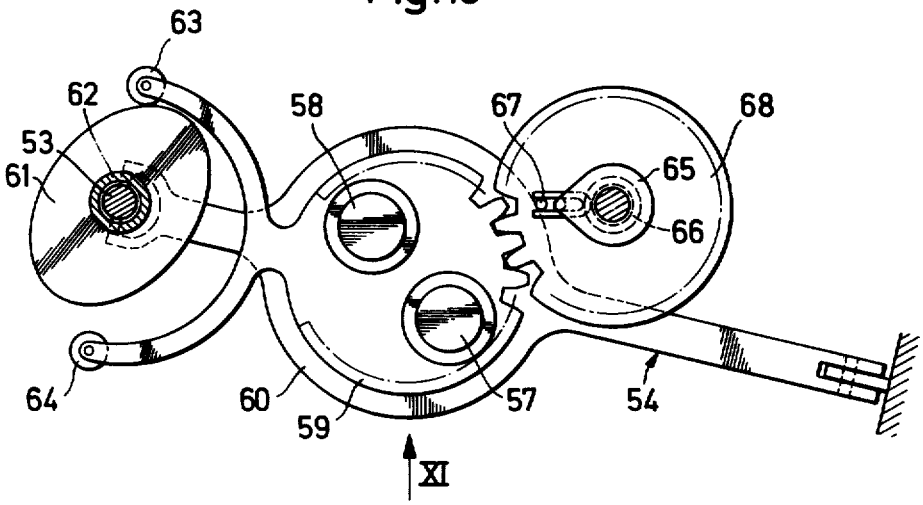

DRIVE AND CONTROL DEVICE FOR WATERCRAFT OR THE LIKE HAVING AT LEAST ONE PAIR OF STEERABLE PROPELLERS

FIELD OF THE INVENTION

The invention relates to a drive and control device for watercrafts or the like and, more particularly, to watercraft having a pair of steerable propellers and control structure for controlling the resulting thrust to effect a complete control over the movement of the watercraft.

BACKGROUND OF THE INVENTION

Ships having several steerable propellers are known which can be pivoted individually or selectively with one common control member, for example a steering wheel. In spite of this, the maneuverability of these ships is not such that it meets all requirements, in particular on tug boats and other work vehicles.

The purpose of the invention is to provide a drive and control device of the above-described type, which permits the watercraft to push or move to all sides without rotating and steering takes place with one single control. Moreover, a desired rotation of the watercraft is also initiatable.

SUMMARY OF THE INVENTION

The objects and purposes of the invention have been met by providing at least a pair of steerable propellers spaced longitudinally along the center line of a watercraft from a center of lateral resistance on the watercraft. The steerable propellers are also equidistant from the longitudinal center line and on opposite sides thereof. The propellers are rotatably supported in underwater housings supported for angular movement through 360°. Control means are provided for varying the direction of applied thrust to the watercraft by systematically varying the axes of rotation of the propellers relative to each other, assuming the thrust force of each steerable propeller is of the same magnitude. The magnitude of the thrust can be, if desired, varied to provide additional control variations for the watercraft.

The invention presents a preferable combination transmission unit for effecting a desired rotation and/or for effecting a desired movement, for example lateral shifting of the ship. It is also possible to advance or control a desired amount of rotation of the ship to effect a most favorable thrust magnitude and thrust direction automatically in dependency of the direction of travel. It is also important for the invention that the thrust force regulation be carried out proportionally relative to a centered position for the thrust control device and that this proportionality is maintained when in controllable pitch-propellers the thrust force becomes negative beyond zero. With the invention it is possible to superpose a rotary movement over the traversing movement also by only changing one of the two directions of thrust.

Further advantages and characteristics of the invention will be apparent from the following description.

BRIEF DESCRIPTION OF THE DRAWINGS

The invention will be discussed hereinbelow with reference to several examples illustrated in FIGS. 1 to 13.

FIG. 8 illustrates a sectional view of one lever control mechanism for controlling both the magnitude of thrust and the amount of steering rotation according to the invention and taken along the line VIII—VIII of FIG. 9;

FIG. 9 is a cross-sectional view taken along the line IX—IX of FIG. 8 and a combination transmission according to the invention;

FIG. 12 is a cross-sectional view taken along the line XII—XII of FIG. 11 and the corresponding combination transmission; and FIG. 13 is a cross-sectional view taken along the line XIII—XIII of FIG. 11.

DETAILED DESCRIPTION

The movement of a watercraft can be divided into two parts, namely a thrust movement (for traversing travel) and an angular or rotary movement.

The center of motion of a ship 1 is the center of lateral resistance 2. In the case of tug boats, it is desirable to locate the towing hook above the center of lateral resistance in order to fixedly locate the center of motion with and without a load. During acceleration, the center of mass is also of importance; it will, however, also always lie near the center of lateral resistance so that the latter can be considered as the exact center of motion.

If a ship is to be moved (traversed) without rotation, the thrust forces relative to the center of lateral resistance, must be torque free or the torque creating moments of the individual thrust forces must cancel one another out. In the case of a normal symmetrical arrangement of the steerable propellers in front of or behind the center of lateral resistance 2 and in the case of a parallel alignment with respect to the longitudinal axis of the ship, a momentfree power application exists; however, only for a forward and backward travel of the ship. A steering device for providing suitable steering angles must be utilized for effecting all lateral movments. Through the inventive deviation from the aforementioned parallel alignment of the steerable propellers, it is possible to produce with a one lever operation momentfree forces in every desired direction. FIGS. 1 to 6 explain the relationships.

Figure 1:
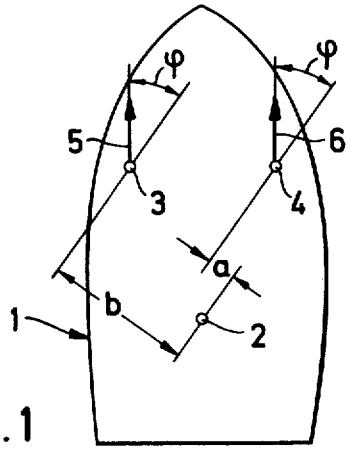
FIG. 1 schematically illustrates a ship having a pair of steerable propellers arranged near the bow with the axes of rotation being aligned parallel for effecting a uniform or common drive of the watercraft.

FIG. 1 schematically illustrates a ship 1 having its center of lateral resistance 2 located rearwardly of the points 3 and 4 where thrust forces are applied to the ship by steerable rotary propellers. The thrust force vectors 5 and 6 are symmetrically related to the center of lateral resistance and parallel to the longitudinal axis of the ship, thus act resultingly momentfree during a forward and backward travel of the ship. If the two steerable propellers are synchronously rotated through a control angle $\psi$, then torques having lever arms a and b result to effect a rotation of the ship.

Figure 2:
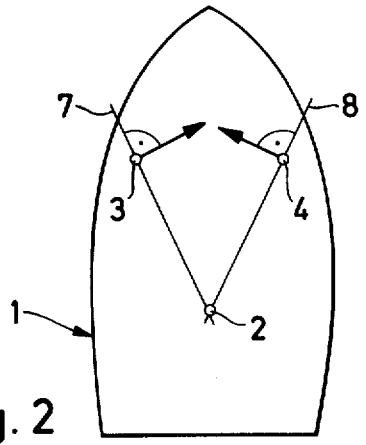
FIG. 2 illustrates a ship according to FIG. 1, in which the axes of rotation of the steerable propellers intersect in an initial position for effecting a pure thrust movement (traversing movement)

FIG. 2 illustrates a position of the thrust vectors of the schematically illustrated steerable propellers and which is important for the invention. This position is defined relative to two lines 7, 8 extending through the center of lateral resistance 2 and the points of application 3, 4 of the thrust produced by the steerable propellers. The steerable propellers are swung in such a manner that the thrust force vectors extend at a right angle to the lines 7, 8 and produce a pure momentfree forward travel of the ship. The moments generated by the thrust forces of the steerable propellers are thereby cancelled out. A reduced resulting forward thrust force, compared to the FIG. 1 position, is created. This thrust force is the maximum possible traversing force, however, when utilizing the principle of the invention. The thrust force can act in every direction and is obtained in each case by a synchronous, swivelling of the steerable propellers in the same angular direction. A torque about the center of lateral resistance is not created in any of these positions.

Figure 3:
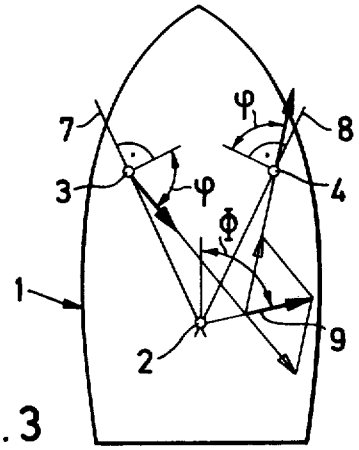
FIG. 3 illustrates the same ship having steerable propellers with the axes of rotation being in a position for effecting a diagonal thrust movement (traversing) forwardly and to the side.

FIG. 3 illustrates how, in the case of a synchronous swivelling of the steerable propellers each clockwise through an angle $\psi$ from the initial position shown in FIG. 2, a resulting thrust force 9 is obtained and which is applied torquefree to the ship relative to the center of lateral resistance 2 through a control angle $\Phi$ relative to the longitudinal axis of the ship. As a result, the ship is moved sidewardly and slightly simultaneously forwardly, namely, diagonally at the angle $\Phi$ relative to the longitudinal axis of the ship.

Figure 4:
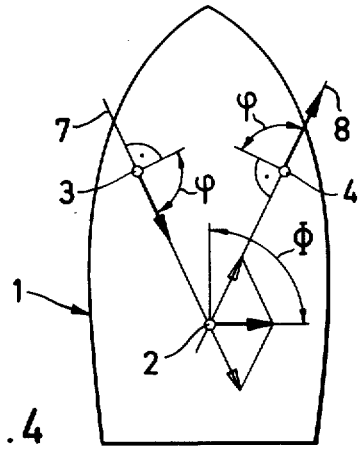
FIG. 4 illustrates the axes of rotation of the steerable propellers in a position for effecting a pure lateral thrust movement.

FIG. 4 shows a resulting control angle of 90° relative to the longitudinal axis of the ship causing the ship to move to the right. A precondition for the described relationships is that the thrust strength of the two steerable propellers is of equal magnitude. Thus the drive motors of the propellers must be driven synchronously at the same speed.

A traversing movement in any desired direction alone without a rotary motion being also present is not sufficient for all maneuvers; because outside forces, such as wind, current, towing forces and the like occur and are not applied exactly to the center of lateral resistance of the ship, or a shifting of the center of lateral resistance occurs due to a different loading and trim. All of these factors can effect a rotation and must be compensated for and controlled. Thus it must generally be possible to superpose an additional rotation movement on a traversing movement.

Figure 5:
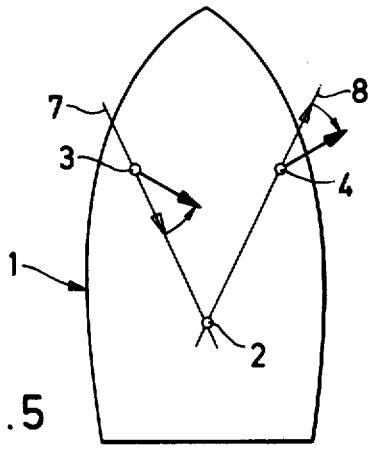
FIG. 5 illustrates the position of the propellers for effecting a rotation of the watercraft plus a transverse shift thereof.
Figure 6:
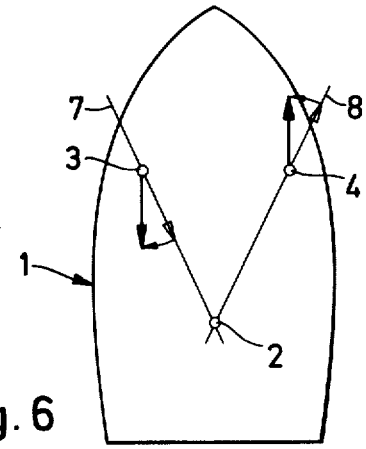
FIG. 6 illustrates the only possibility for a pure rotation of the watercraft with the two steerable propellers.

A torque which is superposed on the thrust force (traversing force) can be produced by rotating the thrust forces against one another out of their normal traversing effecting positions (misalignment). As a result, the magnitude of the traversing force which is available is changed. A traversing movment to the right plus a rotary movement to the right generated by the steerable propellers or thrust forces opposed to one another results in an increased thrust to the right of the ship with a rotation to the right (FIG. 5). A traversing movement to the right plus a rotary movement to the right generated by the steerable propellers opposed to one another results in a reduced thrust to the right of the ship plus a rightward rotation. The traversing movement can also be reduced so much that only a rotation occurs about the center of lateral resistance 2, the only possible pure rotation creating position of the two steerable propellers (FIG. 6).

A torque can also be produced, for example in the position of the steerable propellers illustrated in FIG. 2, by individually varying the thrust forces of the steerable propellers or by mismatching the propeller pitches against one another.

Thus the following functions can be carried out with the invention:

1. A synchronous control of the steerable propellers, so that the axes of rotation are aligned parallel through a 360° movement (FIG. 1).

2. A switching over from parallel alignment of the axes of the steerable propellers to the described traversing position, initial position (FIG. 2).

3. A synchronously controlled swivelling of the steerable propellers in the same angular direction through 360° for effecting a traversing movement.

4. A superposing of rotary movements over the traversing movement by opposing misalignment of the rudder positions.

5. A superposing of rotary movements over the traversing movement through opposing or misaligned thrust for the steerable propellers.

6. A superposing of rotary movements in the traversing movment through the use of unequal propeller pitches.

Figure 7:
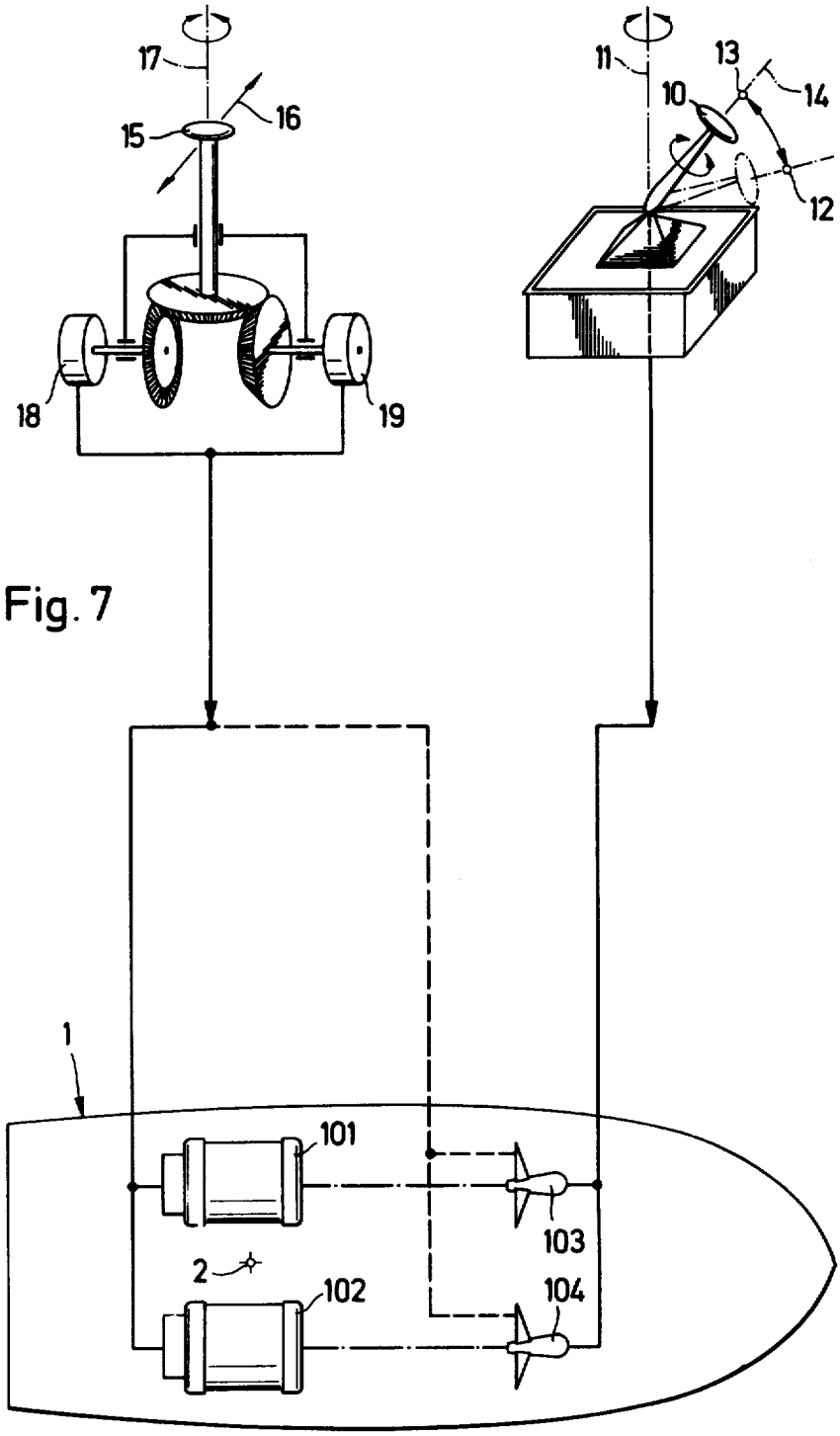
FIG. 7 schematically illustrates an entire system embodying the invention.
Figure 10:
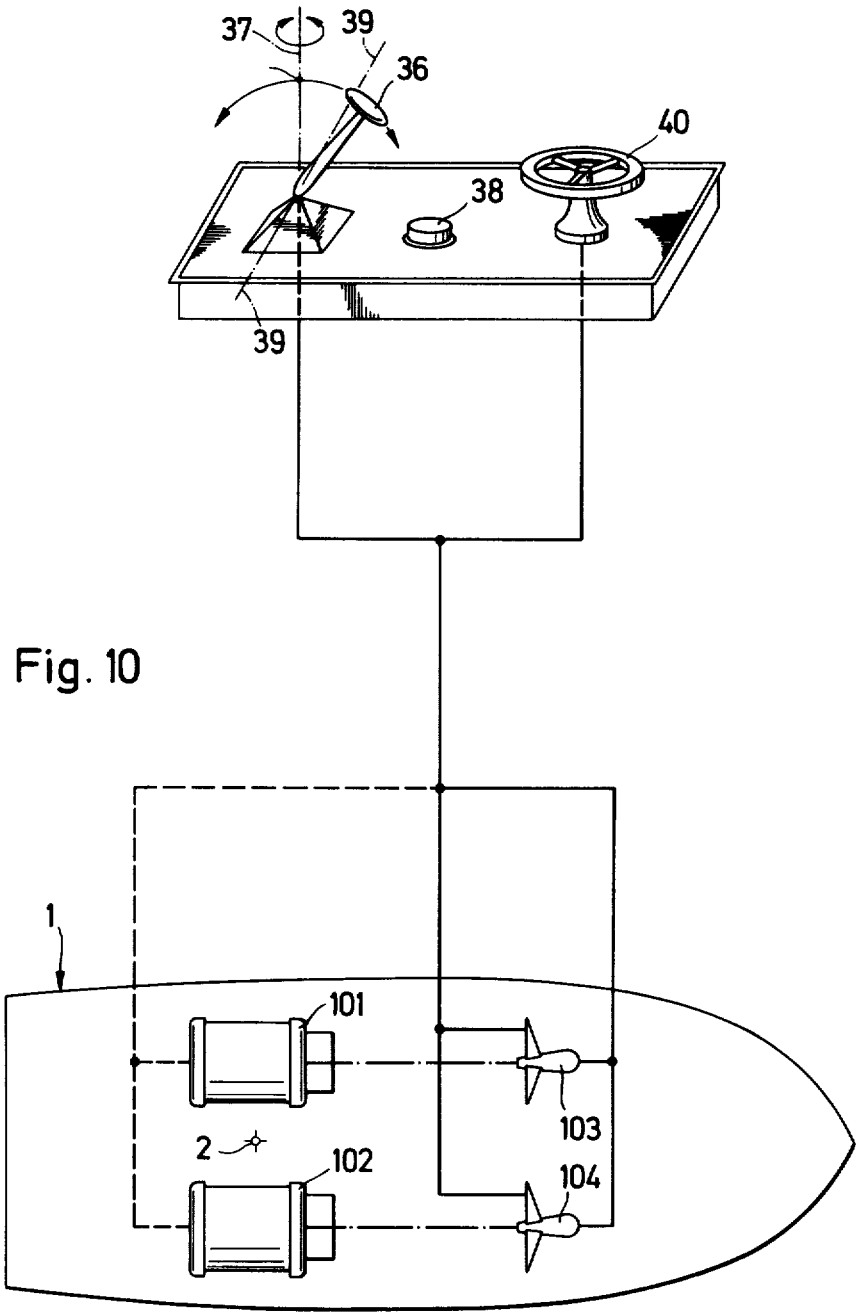
FIG. 10 schematically illustrates an entire system of a different embodiment of the invention.

FIG. 7 schematically illustrates an entire arrangement according to the invention. The thrust direction of the steerable propellers 103, 104 is controlled by a lever 10, said propellers being drivable by the motors 101, 102, respectively, by rotating or swinging the lever 10 about the axis 11. The lever 10 has two stop locations 12 and 13. The axes of rotation of the steerable propellers are aligned parallel to each other in the position 12 and are synchronously controlled turning in the same direction and travel of the ship takes place in a common manner. In the position 13, the steerable propellers are aligned to the initial traversing position (FIG. 2). A rotation or swinging of the lever about the axis 11 advances or alters the traversing direction. The lever 10 can also be rotated about the axis 14. This rotation effects an opposite misalignment of the thrust directions and thus initiates a rotary movement during a traversing movement. The direction of rotation of the lever 10 about the axis 14 corresponds with the direction of rotation of the ship. The thrust strength is advanced or retarded by the lever 15. By movement of the lever 15 in direction 16, the motor speeds or propeller pitches of both units are adjusted synchronously. Upon rotation of the lever about the axis 17, the thrust magnitudes are varied opposite to one another and this also results in a rotation of the ship. The indicated transmission diagram for lever 15 shows how the task can be solved in a mechanically simple manner, if potentiometers 18, 19 are used for the control. Follower control devices with potentiometers as function generators or control members are known and are here not described in any further detail. The same task can also be solved hydraulically or pneumatically. For this too the means are known.

A combination transmission operated by the lever 10 is illustrated in FIGS. 8 and 9. Function generators or control members 20, 21 and 22 are used to control the steerable propellers, which function generators or control members can be potentiometers wherein the system is an electrical system. Instead of function generators which are built up of resistors, it is also possible to use capacitive or inductive control means, of course also hydraulic or pneumatic means or a combined control mechanism. The lever 10 drives the function generator 22 through a hollow shaft 23 and gears 24, 25. The function generator 22 advances or controls the thrust direction at a parallel alignment of the steerable propellers (FIG. 1). The function generators 20 and 21 are driven through gears 26 and 27, which function generators advance or control the thrust direction with the lever position shifted to "traversing" position 13 (FIGS. 2 to 6). The two function generators or transmitters 20, 21 are adjusted corresponding with the geometric conditions on the ship. If the lever 10 is moved from the position 12 into the position 13, a slide member 28 is lifted in response to such movement into engagement with a switch 29 to effect a switching to deactivate the function generator 22 and to activate the function generators 20 and 21 through not shown relays. The gear 24 is arranged for transverse movement on the hollow shaft 23. For this purpose, the gear has an elongated slot 105 therein. If the lever 10 is rotated about the axis 14, then the plate 106 is rotated out of the image plane of FIG. 8 and the gear 24 is, as described, moved transversely. This transverse movement effects an opposing rotation of the gears 26 and 27 and thus also of the function generators 20 and 21. As a result, the mentioned opposing thrust direction misalignment is produced, which effects a rotation of the ship through the predominant cross traversing. In order to keep the gears constantly in engagement, in particular during the transverse movement of the gear 24, the gears 25, 26, 27 are supported on rocker arms 30, 31 and 32. The rocker arms are pressed or pulled by springs 33, 34, 35 into the direction of the center gear 24.

An additional rotation of the function generators 20, 21 can also be done by using helically toothed gears and by moving the center gear 24 in an axial direction.

A torque can also be applied on the ship by rotating the lever 15 about the axis 17. This causes the thrust forces to be misaligned or unequal and for example, in the position according to FIG. 2, a rotation of the ship is generated.

ALTERNATE CONSTRUCTION

A different advantageous embodiment of a combination transmission is illustrated in FIGS. 10 to 13. The lever 36 controls and simultaneously indicates the direction of movement of the ship by rotating or swinging the lever 36 about its vertical axis 37. Whether normal travel with parallel aligned steerable propellers or traversing travel with misaligned steerable propellers is desired, can be selected with a switch 38. A pivoting of the lever 36 about an axis 39 transverses to its length advances or controls the thrust forces by changing either the motor speeds or the propeller pitches. If the propeller pitches are changed, then the lever 36 can be moved beyond zero, namely, the vertical position, into the other direction, which reverses the direction of movement of the ship. In order to achieve during traversing travel an additional rotation of the ship, the handwheel 40 must be rotated. The handwheel 40 effects, depending on the traversing direction, a thrust force or thrust direction misalignment, or both, simultaneously, as long as it is rotated out of its zero position.

Figure 11:
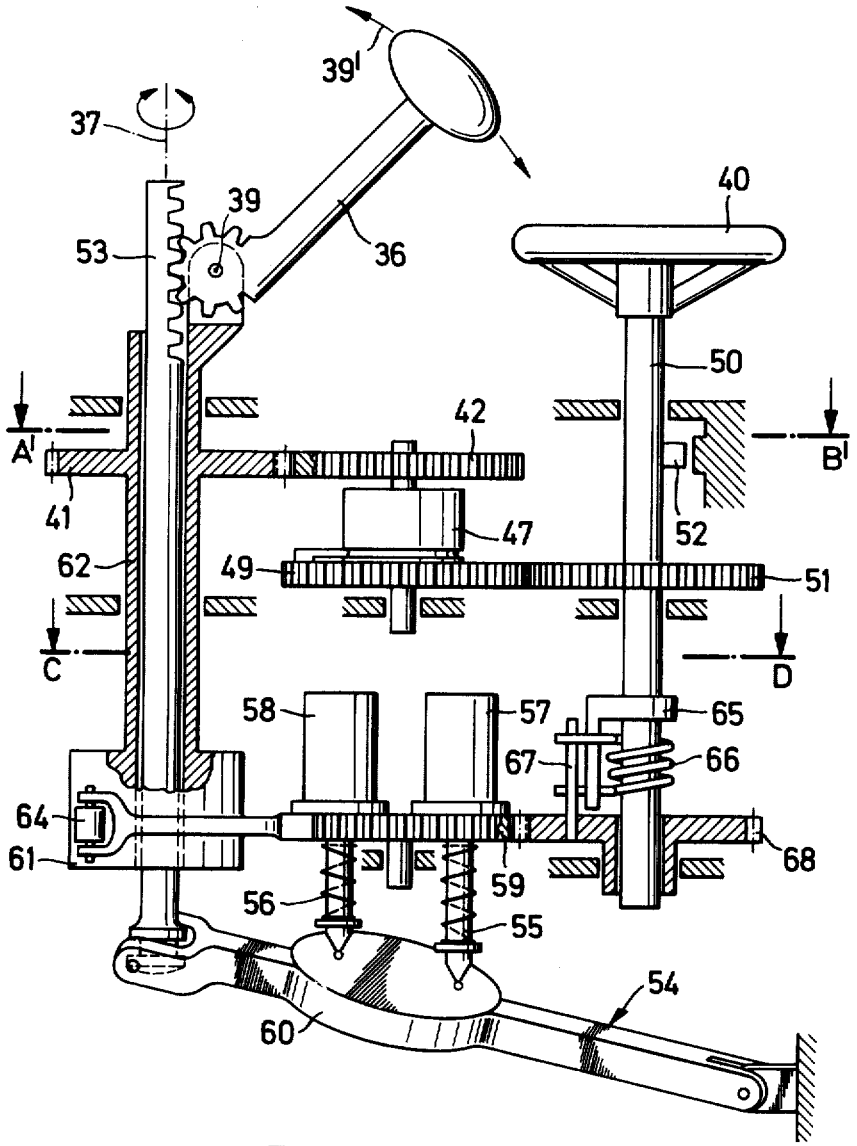
FIG. 11 illustrates a control device, in cross section, for FIG. 10.

FIGS. 11 to 13 illustrate details of the combination transmission. If the lever 36 is rotated about the vertical axis 37, then the function generators 45, 46, 47 are driven through gears 41, 42, 43 and 44. The function generator 45 controls the parallel aligned steerable propellers mode of operation (FIG. 1). The function generators 46 and 47 advance or control the thrust direction of the steerable propellers during a traversing mode of operation (FIGS. 2 to 6). A switch 38 effects a switching to deactivate the function generator 45 and the simultaneous activation of the function generators 46, 47. The housings of the function generators 46 and 47 are secured to the gears 48 and 49 and can be adjusted through a limited angle. They are adjusted by a handwheel 40 through the shaft 50 and gear 51. In order to define the limits of the angle, a stop 52 is mounted on the shift 50. Thus a rotation of the handwheel 40 effects an opposing thrust angular direction change, or misalignment.

If the lever 36 is moved about a horizontal axis 39 in direction 39', either the motor speeds or propeller pitches are adjusted by the variance in the position of a rack 53, in that a rocker arm 54 secured to the rack 53 adjusts the plungers 55 and 56 relative to the housings for the potentiometers 57 and 58 and thus the output of the thrust potentiometers 57 and 58 or equivalent control means. The potentiometers 57 and 58 advance or control the propeller pitches or motor speeds and the housings thereof are secured to a gear 59 which can be angularly adjusted through a limited angle. If this gear is rotated, the plungers 55 and 56 move up or down on the inclined plate portion 60 of the rocker arm 54 and create unequal thrust forces at the propellers. The magnitude of the thrust force difference depends on the angular position of the rocker arm 54 and thus the distance that the lever 36 is moved about the axis 39 from the center position thereof. If no thrust is called for, the lever 36 is in the vertical zero position and the rocker arm 54 extends horizontally. If the lever 36 is moved beyond the zero position, then the thrust force difference is reversed and effects an opposite rotation. This opposite behavior is also produced by the function generators 46 and 47, when the thrust becomes negative beyond zero, which is usually only possible in the case of controllable pitchpropellers.

When the ship is rotated due to thrust difference, the traversing direction is changed. It is therefore advantageous to let the thrust difference only become active in the vicinity of the forward and backward direction. To achieve this, the construction is built such that a rotation of the gear 59 is released through a cam 61. The cam 61 is connected to the direction controlling portion of the lever 36 through a hollow shaft 62. The cam 61 on the lever 36 is engaged by rollers 63 and 64 on a yoke portion of the gear 59 so that a rotation of the gear 59 is possible only during an initiation of a forward and backward travel.

The gear 59 is driven from the handwheel 40 through the shaft 50 and a cam 65. The cam 65 is fixedly connected to the shaft 50 and grips between the legs of an initially tensioned torsion spring 66. The legs of the spring rest on a pin 67 which is secured axially parallel to the axis of a gear 68. If the shaft 50 is rotated, the cam 65 takes along one leg of the torsion spring and tensions same. The second leg of the spring is thereby supported on the pin 67 and takes along the gear 68 until rotation of the handwheel and cam 61 ceases.

The combination transmission shown in FIGS. 12, 13 has the advantage that for a desired ship rotation the correct control magnitudes can be adjusted automatically and in controllable pitch-propellers corresponding tendencies are maintained also beyond the zero thrust position.

In every traversing direction, also forward and backward, a rotation can be attained if only one of the two thrust directions is changed.

The invention is not limited to a pair of steerable propellers, but can also be realized when more than two propellers are provided. If only one pair of steerable propellers is provided, they can be arranged, deviating from the example according to FIG. 1, also at the rear of the ship. The invention relates also to all drive mechanisms, which in the sense of the invention are equivalent with steerable propellers, thus to all drive devices which generate a thrust and can be rotated about the points of application 3, 4.

"To swing in opposite direction" does not refer to a rotation in clockwise direction, but refers to the initial position of the steerable propellers, as it is illustrated in FIG. 2. The steerable propellers move relative to one another in opposite directions, for example the one steerable propeller 3 swings downwardly and the other one 4 upwardly.

The "turning in the same direction" must also be understood relative from FIG. 2, namely, both steerable propellers rotate upwardly or downwardly.

On the other hand, it is equally correct to define the swivelling movement of the steerable propellers in terms of angular direction, and thus clockwise or counterclockwise movement. In such angular terms the propellers in going from their FIG. 2 to FIG. 3 positions can clearly be seen to swivel in the same angular direction, i.e. both swivel clockwise, and thereby effect a change in traversing direction of the ship, without rotating the ship.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a drive and control device for watercraft or the like having at least one pair of steerable propellers which are arranged on both sides of the longitudinal axis of the craft and are pivotable about respective vertical axes and are controllable for such pivoting, the improvement comprising:

an initial position of said steerable propellers in which (1) the direction of the thrust of each is positioned at a right angle to the connecting line between the center of lateral resistance of the watercraft and the respective said vertical pivot axis, and (2) said steerable propellers of each pair are directed to cause straight forward travel of the watercraft and produce equal but opposite torques about the lateral center of resistance of the watercraft; and control means including a common control device and first and second function generators for steering the pivoted positions of the first and second steerable propellers of said pair, said first and second function generators being coupled in positive synchronism and actuable by said common control device for effecting synchronous pivoting of said first and second steerable propellers from said initial position through the same angular displacement in the same angular direction about their respective vertical axes, and thereby for effecting a traversing movement of the craft in a range of selectable directions without rotating the craft, said control means further including a third function generator actuable by said common control device for steering the thrust direction of said steerable propellers when said steerable propellers have their thrust directions in parallel, said control means further including selector means actuable for alternatively selecting said traversing movement of said craft and said parallel pivoting of said steerable propellers, by switching between said first and second function generators on the one hand said third function generator on the other hand, said control means further including superimposing means actuable for causing said first and second function generators to adopt settings different from each other and thereby for superimposing an asynchronous pivoting of said steering propellers on said synchronous pivoting thereof, so as to superimpose a rotation of said craft on said traversing thereof.

2. A drive and control device according to claim 1 in which said control means includes a single control member for both said synchronous pivoting in the same angular direction of rotation and said superimposing, said common control device including said single control member and being coupled to said superimposing means as well as to said first and second function generators.

3. A drive and control device according to claim 1, in which said control means includes a single control member for said synchronous pivoting and for said parallel pivoting, said common control device including said single control member and being coupled to said third function generator as well as to said first and second function generators.

4. A drive and control device according to claim 1, wherein each steerable propeller has at least one drive motor and including a further control device for synchronously controlling the outputs of said drive motors of each said pair of steerable propellers.

5. A drive and control device according to claim 1, in which said common control device includes transmission means and a common control member actuable to rotate an input member of a said function generator through said transmission means.

6. A drive and control device according to claim 5, in which said superimposing means includes further transmission means and wherein said input member of said function generator is actuable by said control member through said further transmission means for superposing on said function generator an oppositely directed additional rotation.

7. A drive and control device according to claim 5, wherein said superimposing means includes a second control member and said function generator has an output member driven by said second control member to carry out an additional rotation of said function generator.

8. A drive and control device according to claim 1, including means wherein the blades of said pair of steerable propellers can be synchronously adjusted.

9. A drive and control device according to claim 8, including means wherein an asynchronous adjustment is superposed over the synchronous adjustment for said propeller blades.

10. A drive and control device according to claim 1, wherein said connecting lines of each pair of steerable propellers form an acute angle and said vertical axes of said steerable propellers are offset along the length of the watercraft from said center of lateral resistance and such that said vertical axes and center of lateral resistance are at the vertices of a triangle, said propeller thrust directions being nonparallel in their said initial position.

11. In a drive and control device for watercraft or the like having at least one pair of steerable propellers which are arranged on both sides of the longitudinal axis of the craft and are pivotable about respective vertical axes and controllable for such pivoting, the improvement comprising:

an initial position of said steerable propellers in which (1) the direction of the thrust of each is positioned at a right angle to the connecting line between the center of lateral resistance of the watercraft and the respective said vertical pivot axis, and (2) said steerable propellers of each pair are directed to cause straight forward travel of the watercraft and produce equal but opposite torques about the lateral center of resistance of the watercraft; and control means including a common control device actuable for synchronously and in the same angular direction pivoting the steerable propellers of each pair from said initial position about their said respective vertical axes, said common control device comprising a control lever mounted for vertical pivoting between a parallel propeller thrust position and a traversing nonparallel propeller thrust position, said lever being further mounted for horizontal rotating continuously in a circle for rotating said steerable propellers about their said vertical axes in synchronism such that said propellers pivot through identical angles at the sme time, said lever being further mounted for rotation about its own length axis for superposing on said synchronous pivoting of said propellers a relative angular displacement therebetween.

12. A drive and control device according to claim 11, in which said control means comprises a fixed central axis, a hollow shaft rotatable on said fixed central axis and rotatable with a central gear, first and second and third gears resiliently urged into rotative driven engagement with said central gear, first and second potentiometers having shafts coaxially driven by said first and second gears for accordingly steering the pivoted position of first and second ones of said pair of steerable propellers respectively, a third potentiometer having a shaft driven by said third gear and alternatively electrically selectable to control the thrust direction of said steerable propellers when the latter have their thrust directions lying in parallel, means securing said hollow shaft to said lever for rotation by said horizontal rotation of said lever, the last-mentioned means including a horizontal pivot supporting said lever on said hollow shaft for said vertical pivoting movement of said lever, means vertically guided by said hollow shaft for actuating a propeller position selector switch in response to vertical swinging of said lever between its traversing and parallel propeller positions, said means pivotally supporting said lever on said hollow shaft permitting said rotation of said lever about its longitudinal axis, said central gear including a slot by which it is shiftable diametrically of said hollow shaft for producing a relative rotation between said first and second gears flanking said central gear, and a linkage connecting the inner end portion of said lever with said central gear and responsive to said rotation of said lever about its own longitudinal axis for carrying out said diametral displacement of said central gear with respect to said hollow shaft, said linkage being responsive to said horizontal rotation of said lever about said axis for correspondingly rotating said central gear, said switch being connectible to select between said third potentiometer in one state and said first and second potentiometers in its other switched state.

13. In a drive and control device for watercraft of the like having at least one pair of steerable propellers which are arranged on both sides of the longitudinal axis of the craft and are pivotable about respective vertical axes and controllable for such pivoting, the improvement comprising:

an initial position of said steerable propellers in which (1) the direction of the thrust of each is positioned at a right angle to the connecting line between the center of lateral resistance of the watercraft and the respective said vertical pivot axis, and (2) said steerable propellers of each pair are directed to cause straight forward travel of the watercraft and produce equal but opposite torques about the lateral center of resistance of the watercraft; and control means including a common control device actuable for synchronously and in the same angular direction pivoting the steerable propellers of each pair from said initial position about their said respective vertical axes, said common control device comprising a lever pivotable in a vertical plane to control propeller thrust magnitude and horizontally rotatable about a vertical axis to control traversing direction of said propellers by pivoting of said steerable propellers synchronously from their said initial position, said control means further including a hand wheel rotatable for superposing a relative pivoting of said steerable propellers with respect to each other upon said synchronous pivoting thereof.

14. A drive and control device according to claim 13, in which said control means comprises a hollow central shaft rotatable on said vertical axis of said lever and fixedly supporting a central gear, first and second potentiometers having shafts driven by said central gear through respective first and second gears for effecting said synchronous pivoting of said steerable propellers, a third potentiometer driven by a third gear from said central shaft and switch means for selecting said third potentiometer to control direction of thrust of said propellers in a parallel propeller thrust mode in place of said first and second potentiometers, engaging fourth and fifth gears respectively fixed to the bodies of said first and second potentiometers and a sixth gear driven by said hand wheel and engaging said fifth gear for causing said potentiometers to adopt different settings from each other upon rotation of said hand wheel for superimposing an asynchronous pivoting of said steerable propellers on the synchronous pivoting thereof and thereby superposing a rotation of the watercraft on the traversing thereof, said lever being mounted on said hollow shaft to rotate same and effect rotation of said first, second and third gears, said lever being pivotally fixed by horizontal axis means to said hollow shaft for pivoting in said vertical plane and carrying a pinion segment, a rack engaged by said pinion segment for raising and lowering same in response to vertical pivoting of said lever, said rack being coaxially guided in said hollow shaft, a rocker arm pivoted up and down in response to reciprocation of said rack, said hollow shaft carrying a cam adjacent said rocker arm for rotation with said hollow shaft, a gear member having a yoke extending eccentrically therefrom and engaging the cam to rotate such gear member through a partial rotation in response to rotation of said lever about said vertical axis thereof, said gear member carrying a pair of potentiometers having axially shiftable plungers engageable with a widened portion of said rocker arm to vary the adjustment of said plungers in response to rotation of said gear member and the vertical position of said rack, said last-mentioned potentiometers being connectible to control propeller thrust force, a further gear engaging said gear member and resiliently connected to said hand wheel to further control actuation of said last-mentioned potentiometers in response to rotation of said hand wheel.

* * * * *